US012486663B2

(12) United States Patent
Dwarshuis et al.

(10) Patent No.: US 12,486,663 B2
(45) Date of Patent: Dec. 2, 2025

(54) RENEWABLE LIGHTWEIGHT COMPOSITE ASSEMBLY

(71) Applicant: HOLLAND COMPOSITES B.V., Lelystad (NL)

(72) Inventors: PieterJan Dwarshuis, Lelystad (NL); Sven Erik Janssen, Lelystad (NL)

(73) Assignee: HOLLAND COMPOSITES B.V., Lelystad (NL)

( * ) Notice: Subject to any disclaimer, the term of this patent is extended or adjusted under 35 U.S.C. 154(b) by 274 days.

(21) Appl. No.: 18/039,328

(22) PCT Filed: Nov. 30, 2021

(86) PCT No.: PCT/NL2021/050724

§ 371 (c)(1),
(2) Date: May 30, 2023

(87) PCT Pub. No.: WO2022/114959

PCT Pub. Date: Jun. 2, 2022

(65) Prior Publication Data

US 2024/0003133 A1 Jan. 4, 2024

(30) Foreign Application Priority Data

Nov. 30, 2020 (NL) ..... 2027014

(51) Int. Cl.
*E04B 5/12* (2006.01)
*E04B 5/48* (2006.01)

(52) U.S. Cl.
CPC . *E04B 5/12* (2013.01); *E04B 5/48* (2013.01)

(58) Field of Classification Search
CPC ... E04B 5/12; E04B 5/48; E04B 5/026; E04B 1/14; E04C 2/52; E04C 2/34; E04C 2/38
See application file for complete search history.

(56) References Cited

U.S. PATENT DOCUMENTS 2,571,994 A 10/1951 Beaumont
3,732,138 A * 5/1973 Almog ..... E04C 2/205 428/416

(Continued)

FOREIGN PATENT DOCUMENTS

EP 0613985 B1 10/1997
EP 1005513 A1 6/2000

(Continued)

OTHER PUBLICATIONS

International Search Report from corresponding PCT Application No. PCT/NL2021/050724, dated Feb. 18, 2022.

(Continued)

*Primary Examiner* — Gisele D Ford
(74) *Attorney, Agent, or Firm* — Harness, Dickey & Pierce, P.L.C.

(57) ABSTRACT

The present invention relates to a lightweight composite architectural panel assembly, comprising: a) at least a first and a second end joist spaced parallelly along a perimeter of the assembly, each having a length; b) at least one web plate spaced parallelly between the end joists; an upper surface arranged in parallel to a lower surface; and attached to the at least first and a second end joist and the web plate, forming one or more channels disposed vertically between the upper and lower surfaces and longitudinally extending along the upper and lower surfaces, thereby forming an open-ended boxlike body; and c) a structural vertically load-bearing sheathing layer enveloping and adherent to the outer surface of the open-ended boxlike body, wherein the sheathing layer comprises a composite skin comprising a fibre mesh and a crosslinked polymeric resin system.

12 Claims, 2 Drawing Sheets

(56) References Cited

U.S. PATENT DOCUMENTS 4,329,827 A * 5/1982 Thorn ..... E04C 2/36 52/794.1
5,052,164 A * 10/1991 Sandow ..... E04C 2/34 52/786.13
5,188,879 A * 2/1993 Hill ..... B29C 44/08 428/117
5,309,690 A * 5/1994 Symons ..... B32B 29/08 428/116
5,390,468 A * 2/1995 Probst ..... E04F 13/144 428/116
5,393,588 A * 2/1995 Weddendorf ..... B32B 3/18 428/184
5,526,625 A * 6/1996 Emblin ..... E04C 2/36 52/270
5,794,402 A * 8/1998 Dumlao ..... B63B 3/48 52/783.17
5,806,264 A * 9/1998 Boot ..... E04C 2/041 52/781.5
5,850,722 A * 12/1998 Yasui ..... E04C 2/36 52/801.1
5,914,175 A * 6/1999 Nudo ..... E04C 2/543 156/60
6,081,955 A * 7/2000 Dumlao ..... E01D 2/00 52/783.17
6,122,880 A * 9/2000 Kolb ..... E04C 1/40 52/503
6,244,008 B1 6/2001 Miller
6,467,118 B2 * 10/2002 Dumlao ..... E04D 13/1656 52/783.17
6,514,368 B1 * 2/2003 Holtslag ..... E04C 2/365 52/783.17
6,759,114 B2 * 7/2004 Wu ..... E04C 2/543 428/188
7,562,508 B2 * 7/2009 Dickinson ..... E04B 1/34321 52/793.1
8,389,104 B2 * 3/2013 Day ..... E04C 2/36 416/223 R
8,814,091 B2 * 8/2014 Zorzetto ..... B62D 25/2054 244/119
9,133,620 B1 * 9/2015 Huguet, Sr. ..... E04C 2/34
9,441,363 B2 * 9/2016 Lewin ..... E04C 2/521
2003/0072920 A1 * 4/2003 Klinger ..... B32B 3/20 428/188
2003/0159400 A1 * 8/2003 Forrester ..... E04B 1/80 52/783.17
2004/0068949 A1 * 4/2004 Richards ..... E01D 19/125 52/630
2004/0074205 A1 * 4/2004 Stache ..... E04C 2/36 52/793.1
2004/0074206 A1 * 4/2004 Tanase ..... E04B 1/86 52/783.17
2006/0266001 A1 * 11/2006 Barker ..... E04C 2/34 52/790.1
2007/0095016 A1 * 5/2007 Sakae ..... E04C 2/08 29/897.32
2008/0163587 A1 * 7/2008 Monk ..... E04C 2/34 52/794.1
2010/0080941 A1 * 4/2010 McCarville ..... B29D 24/004 428/179
2011/0268928 A1 * 11/2011 Jurcik ..... B29C 48/08 428/188
2012/0291375 A1 * 11/2012 Park ..... E04C 2/20 52/220.3
2016/0153191 A1 * 6/2016 Henderson ..... E04C 2/46 52/586.1
2017/0241134 A1 * 8/2017 McCloud ..... B62D 33/02
2017/0284096 A1 * 10/2017 Abe ..... E04C 2/34
2019/0211557 A1 * 7/2019 Moghaddam ..... E04B 2/62
2019/0242127 A1 * 8/2019 Kreizinger ..... E04B 2/707
2020/0141118 A1 * 5/2020 Kreizinger ..... B32B 27/40
2020/0199871 A1 * 6/2020 Mcguire ..... E04C 2/10
2021/0372125 A1 * 12/2021 Thomson ..... E04C 2/46

FOREIGN PATENT DOCUMENTS

FR 2550253 A1 2/1985
FR 3003878 A3 10/2014
JP H11159026 A 6/1999

OTHER PUBLICATIONS

Written Opinion from corresponding PCT Application No. PCT/NL2021/050724, dated Feb. 18, 2022.

* cited by examiner

RENEWABLE LIGHTWEIGHT COMPOSITE ASSEMBLY

CROSS-REFERENCE TO RELATED APPLICATIONS

This application is a national phase application of PCT Application No. PCT/NL2021/050724, filed on 30 Nov. 2021, which claims the benefit and priority to Netherlands Patent Application No. 2027014, filed on 30 Nov. 2020. The entire disclosures of the applications identified in this paragraph are incorporated herein by references.

FIELD OF THE INVENTION

The present invention relates to a structural, weight-bearing floor assembly, and its manufacture.

BACKGROUND OF THE INVENTION

In designing floor structures for buildings, a number of factors are important, notably the combination of the load bearing capacity, bending strength, as well as fire retardancy. The floor should also have other important features, for example, it should be relatively easy to install as well as be capable of accommodating building services such as HVAC, plumbing, as well as fibre optics and other communication cables. Yet another important factor is that the floor structure should be compatible with potential floor coverings to be used over it, including noise dampening.

Particularly desirable is a floor structure that is integrated into a single piece unit, which can be lifted by a crane and installed in place. By preparing the floor in this manner, it needs only to be installed once it is delivered on site. Accordingly, because the floor unit does not have to be assembled on site, it can be manufactured in a plant, which allows greater realization of economies of scale, more rigorous quality control, and means that production of the floor structure is not interrupted by inhospitable weather. Accordingly, there is a need in the art for a floor structure that is integrated into a single unit capable of being prefabricated and mass produced.

Several prefabricated floor structures have been proposed in the past. For example, U.S. Pat. No. 6,244,008 discloses a pre-assembled floor composed of layers of steel, insulation and cement. While this floor is capable of being pre-assembled, it has a number of drawbacks, notably a lack of workability, difficulty of use and a general incompatibility between its cement surface and floor coverings to be installed on this surface. Also, the high weight of the individual units requires very strong foundation walls or supporting beam members, which may render the disclosed units unsuitable for the refurbishment of older existing structures.

Another structural panel is proposed in European Patent No. EP0613985, which discloses wood-concrete construction member having a framework of wood joists on which a concrete plate is moulded, thereby forming a prefabricated structural panel. However, while lighter than reinforced concrete panels, these panels are still suffering from high weight, and are not likely to fulfil fire retardancy requirements without extensive flame-retardant treatment of the beams or joists.

Composites involving wood materials have been described for instance in FR3003878; EP1055513 and JPH11159026.

Accordingly there remains in the art a need for a floor structure that is capable of being prefabricated or preassembled, is compatible with desired floor coverings, has an inherent fire retardancy, is prepared from sustainable materials, and lightweight relative to comparable structures, and thus easy to set in place and install.

BRIEF SUMMARY OF THE INVENTION

In a first aspect, the present invention relates to a lightweight composite architectural panel assembly, comprising: a) at least a first and a second end joist spaced parallelly along a perimeter of the assembly, each having a length; b) at least one web plate spaced parallelly between the end joists; an upper surface arranged in parallel to a lower surface; and attached to the at least first and a second end joist and the web plate, forming one or more channels disposed vertically between the upper and lower surfaces and longitudinally extending along the upper and lower surfaces, thereby forming an open-ended boxlike body; and c) a structural vertically load-bearing sheathing layer enveloping and adherent to the outer surface of the open-ended boxlike body.

In a second aspect, the present invention relates to a method of manufacturing an assembly according to the invention, comprising: a. providing a fibre mesh impregnated with a resin and curing agent; b. providing at least a first and a second end joist spaced parallelly along a perimeter of the assembly, each having a length; at least one web plate spaced parallelly between the end joists; an upper surface arranged in parallel to a lower surface; and attached to the at least first and a second end joist and the web plate, forming one or more channels disposed vertically between the upper and lower surfaces and longitudinally extending along the upper and lower surfaces, thereby forming an open-ended boxlike body; and joining the joins and web plate to the upper and lower surface by providing strips of the fibre mesh impregnated with a resin and curing agent as adhesive joints upon curing; c. for each side of the box-shaped element, applying a portion of the impregnated fibre mesh onto the core so that the second face of the impregnated fibre mesh is in contact with the core, thereby forming a sandwich construction; and d. subjecting the precured assembly to a curing process under conditions that are suitable for crosslinking the resin, wherein curing temperature, curing speed, viscosity, water content, and curing pressure such to compress the impregnated fibre mesh and allow for ingression of at least part of the resin into the assembly prior to curing.

The boxlike structure may have a regular rectangular cross section, a polygon or a trapezoid or triangular cross section, where for instance load forces are to be distributed on a thicker or higher web spar. Other examples include roof constructions, where polygon, triangular or trapezoid structures may be useful. In such a case, the upper and lower surface plates may be positioned at an angle in the range of from 0° to 45° deviating from the parallel plane with regard to the respective other surface; and her two or more plates may be joined. Preferably the first and second surface may be arranged in a rectangular, triangular, polygon or trapezoid shape, wherein preferably the upper or lower surface are arranged in parallel, or wherein the one or more upper or one or more lower surfaces are arranged at an angle to a respective upper or lower surface. The present invention advantageously makes use of wood composite panels, i.e. the one or more upper surface(s), the one or more lower surface(s), the joints and/or the web plate may comprise a wood composite panels. Boxlike wooden structures, using wooden or like sheeting have been well known, see for instance FR2550253. However, the disclosed sheathing does not attain the increase in stability and fire retardancy shown for the present invention.

In a further aspect the present invention relates to a composite load bearing panel having a sandwich construction obtainable according to the process, and to its use in building constructions.

BRIEF SUMMARY OF THE DRAWINGS

Embodiments will now be described more fully with reference to the accompanying drawings in which.

DETAILED DESCRIPTION OF THE INVENTION

Figure 1:
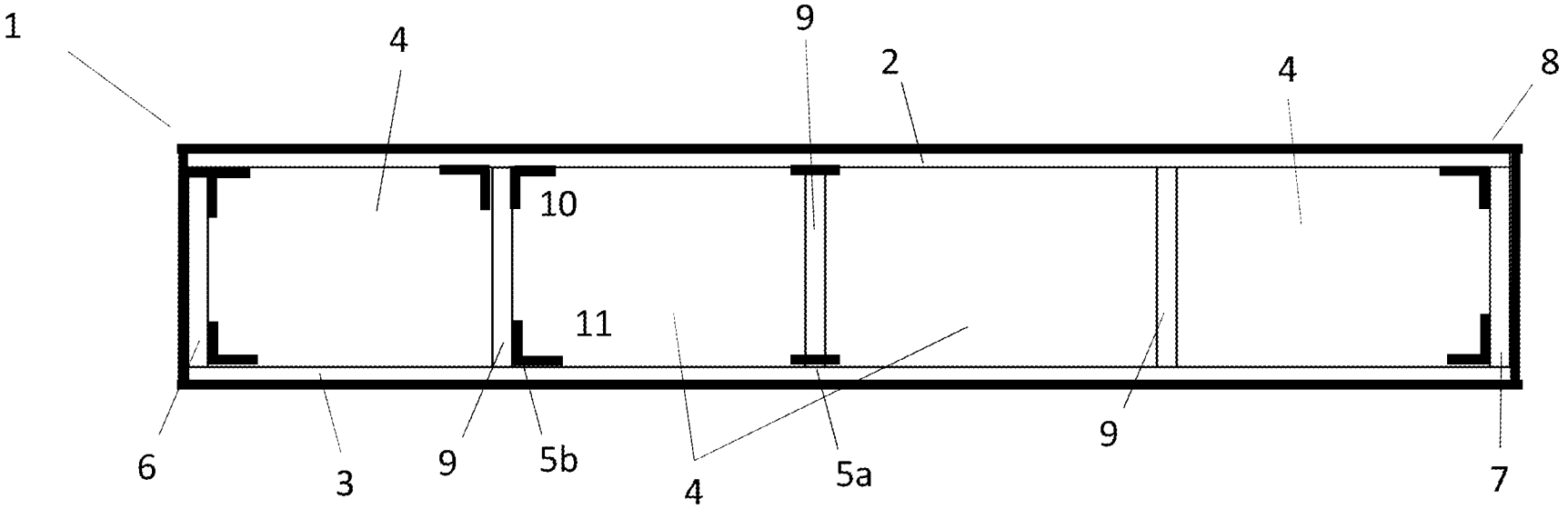
FIG. 1 is a cross-sectional side view of a structural flooring panel.

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibres bonded together by lignin polymer.

By "laminated", it is meant herein material composed of layers and bonded together using resin binders.

By "wood composite material" or "wood composite component" it is meant a composite material that comprises wood and one or more other additives, such as adhesives or waxes. Non-limiting examples of wood composite materials include oriented strand board ("OSB"), laminated veneer lumber (LVL), oriented strand lumber (OSL), structural composite lumber ("SCL"), waferboard, particle board, chipboard, medium-density fibreboard, plywood, and boards that are a composite of strands and ply veneers. As used herein, "flakes", "strands", and "wafers" are considered equivalent to one another and are used interchangeably. A non-exclusive description of wood composite materials may be found in the Supplement Volume to the Kirk-Othmer Encyclopedia of Chemical Technology, pp 765-810, $6^{th}$ Edition.

In residential constructions, a floor is typically built upon a conventional foundation which supports a floor comprised of a series of parallel, spaced apart floor joists, with a wood decking fastened upon them. Such floors are usually not employed for functional buildings, though.

According to the present invention, the floor is not built on site, but instead is built in floor structure segments elsewhere, e.g. in a manufacturing plant or similar facility, and transported to the construction site where it is lifted into place and installed by use of a crane during construction of a building. The structural components of the floor system are combined in the unit, such that no additional floor joists are required to hold up the structure. This floor structure has yet additional advantages as well because it is capable of accommodating the infrastructure to hold a variety of building services such as HVAC ducts, plumbing pipes, and conduits for fibre optic cables as well as other types of communication cables.

Applicants have found that the floor assemblies or panels of the invention solve the problem of fire retardancy in a lightweight composite construction useful for building application, with a minimum of additional fire retardants or fire protection materials due to the inherent high fire retardancy of the subject materials.

Preferably, the sheathing layer comprises a composite skin comprising a fibre mesh and a crosslinked polymeric resin system.

Preferably, the upper surface, the lower surface, the joints and/or the web plate comprise a wood composite panel. Preferably, the wood composite panel are oriented strand board, preferably, wherein the plurality of wood composite panel are composed of oriented strand board (OSB). Preferably, the assembly comprises an adhesive joint applied between an upper and lower surface of the joints and web plates and the inner surface of the top and bottom sheathing.

Preferably, the polymeric resin system comprises Polyfurfuryl Alcohol (PFA) resins, and appropriate curing and/or crosslinking agents. Preferably, the sheathing layer comprises a fibre mesh at least partially impregnated with the Polyfurfuryl Alcohol (PFA) resin and in part cured prior to the enveloping and crosslinking process to prepare the assembly.

The configuration of the floor structure is illustrated in FIG. 1. The floor structure 1 comprises an upper surface 2 arranged in parallel to a lower surface 3, and composite skin 8 encasing the structure. One or more channels 4 are disposed vertically between the upper surface 2 and lower surface 3, and at least two joists 6 and 7, and these channels extend longitudinally along the length of the upper surface 2 and lower surface 3 as shown in FIG. 1. Each of the one or more channels are formed by a web plate 9 having a top 10 attached to the upper surface 2, optionally with a strip of a composite material 5*a* or 5*b*, and a bottom surface 11 attached to the lower surface 3, and at least one web plate supporting and connecting the upper and lower surfaces.

Panel Composition

Joists and Web Plates

The joists and web plates, which act as stiffeners, may be made from the same materials or different materials, preferred are the same materials is wood composite materials more preferably OSB boards, and shaped to fit snugly inside the area of the channel at suitable intervals, and at the supporting ends. As mentioned above, the channels, and the spaces between the channels, are useful for accommodating insulation material, HVAC ducts, plumbing pipes, and fibre optic cables as well as other types of communication cables.

As mentioned above, the web plates are securely attached to the upper and lower surfaces, which may include the use of nails, screws, adhesives, or other permanent fasteners. However, preferably, the web plates are fastened by using the same fibre enforced prepared material as is used for the outer shell. Herein, the bio-resin acts as an adhesive that ensures that the channels are sufficiently fastened to the upper and lower composite boards so that the channels can bring strength reinforcing properties as described above.

The web plate may additionally comprise extending tabs or other structural connectors that facilitate attachment of the members to the upper and lower surface. This out layer as well as the adhesive strips is typically applied in strips of a typical width of about 2 cm wider than the thickness of the web plate, but wider or narrower strips may also be suitably employed depending on the specific individual needs. Also, similar strips may be added to corners, to form the interior joints.

Upper and Lower Surface Panels

Preferably, the upper surface, the lower surface, the joints and/or the web plate comprise a wood composite panel. The joists, and the upper surface 5 and lower surface 8 of the present invention will typically be constructed of one or more wood composite floor panels. For example, the surface may be composed of a single sheet of OSB of standard sizes, or the desired size of the flooring unit. The bottom panel then preferably is also a piece of the same length and width as the top surface. Alternatively panels of other dimensions may be used.

The wood composite boards which form the surfaces may vary in thickness, i.e. one may be made thinner than other, usually, the wood composite boards which form the upper surface 5 would be thicker. The wood composite is preferably OSB material, but other known wood composite materials as mentioned above may be used also.

The wood composite boards which form the lower surface 5 preferably have a thickness of from 1.0 cm to 3.5 cm, preferably at least 1.2 cm, yet more preferably at least 1.5 cm. The wood composite boards which form the upper surface 8 have a thickness of from 1.0 cm to 4.0 cm, preferably at least 1.2 cm, yet more preferably at least 1.5 cm, yet more preferably at least 1.8 cm.

Preferred wood composite materials for both joists, web plates and surfaces may be selected from the classes 1 to 4 of OSB materials, e.g. OSB/1, i.e. boards with no load transfer, OSB/2 board, i.e. with load transfer properties, suitable for applications in dry conditions; OSB/3 boards, i.e. boards with load transfer properties, suitable for usage class according to PN-EN 13986 applications in moderate humidity conditions, or OSB/4 boards, designated as special heavy-duty boards for loadbearing applications, as determined by the DIN EN 300 standard.

The boards may have a suitable thickness as adequate for loadbearing uses and dimensional stability, whereby a greater thickness will increase the required structural strength.

The present floor structure also includes one or more channels 14, which are useful to accommodate a variety of different building related compounds, such as HVAC equipment a ducts, electricity and telecommunication cables and wiring, plumbing and other important connections; and/or the channels may comprise suitable sound or energy loss insulating materials.

Preferably, the channels may comprise additional web plates acting as stiffeners in one or more channels. Depending on the use and location, these may be solids, or may comprises holes to allow the passage of the cables, wiring, and plumbing along a length. The channels may have also preformed openings in the sides to accommodate the passage of cables, wiring, and plumbing along the floor's width, or, where desired contain the cables, wiring, and plumbing with standard connectors.

Panel Dimensions

The width of a preferred floor structure unit may range of from 90 cm to 900 cm, preferably of from 120 cm to 400 cm.

The length of a preferred floor structure unit may range of from, 120 cm to 1200 cm, preferably of from 240 cm to 900 cm.

The floor panel thickness preferably is in the range of from 20 cm to 60 cm, preferably of from 25 to 55 cm, yet more preferably of from 30 to 50 cm.

While the channels 14 are illustrated in the present drawing as straight walls forming a square or rectangular cross-section, the shape of each of the channels may vary according to the specific design necessary for implementation of the floor structure. The channels may for instance advantageously be formed in a V-shaped cross section, or some other suitable shape.

The present panels comprise outer joists, top and bottom surfaces, and at least a web plate intermediate the joists. This sandwich panel is enveloped by a structural vertically load-bearing sheathing layer enveloping and adherent to the outer surface of the open-ended boxlike body.

Additional options or features can be added to the panels as well. For example, tongue and groove surfaces (not illustrated in figures) can be added to the edges of the floor structure to ensure good, tight fits with adjacent floor structure pieces.

Similarly, interlocking cams (not illustrated in figures) may optionally be placed along the longitudinal edges of the floor structure in order to provide a better mechanical grip between adjacent and adjoining floor structure units, and a seamless connection, since they allow to pull the panels tight during assembly. Also machined holes or other suitable fastening means may be added to the panel as a means of easily attaching cables for lifting and lowering the panel into place with a crane.

An additional optional feature not shown in FIG. 1 is a blocking member 11, which is disposed vertically between the upper surface 2 and lower surface 3, and permanently affixed thereto.

The floor structure may comprise blocking members, and/or other web members as useful or required for specific purpose, e.g. strengthening certain areas of the panel. These may also be from a wood composite material as set out herein above, or other suitable material.

Utilizing the floor structures according to the invention allows for buildings to be easily upgraded in the future when necessary or when more sophisticated equipment becomes available, and therefore using a modular approach to refurbish existing industrial or residential building structures.

Yet another advantage of the panel according to the present invention is that it also increases the performance of the floor structure because the distribution of forces between individual channels, and the transfer to load to the lower surface acts to reinforce the floor structure in the area where the high tension forces make the floor structure less likely to fail as compared to single slab concrete composites, at a fraction of the weight. This is particularly beneficial for the refurbishment of older building structures, or where lightweight foundations are required, e.g. where buildings placed on sand or silt ground.

Preferably, in the assembly according to the invention, the sheathing layer comprises a composite skin comprising a fibre mesh and a crosslinked polymeric resin system.

Binder Components

The resin binder system used in the present invention may be selected from a variety of different binder materials comprising PolyFurfuryl Alcohol (PFA). The selection will largely depend on the cost and performance targets specified.

The binder composition comprises the bio-resin comprises PolyFurfuryl Alcohol (PFA) as a bio resin. As such, the bio-resin advantageously is not a phenolic resin as may be found in connection with the manufacturing of conventional fire-rated laminates. The bio-resin is a resin that derives some or all of its constituent monomers from biological sources.

Preferably, the bio-resin comprises PolyFurfuryl Alcohol (PFA) as the polymeric backbone component. In some embodiments, the bio-resin does not comprise fire resistant filler or additive material. In some embodiments.

Advantageously, such systems can be prepared comprising no Volatile Organic Compounds (VOC) as typically found in phenolic or epoxy resins. As a result, the bio-resin may reduce exposure to potential chemical hazards that may otherwise typically occur during manipulation of phenolic or epoxy resin.

Where reference is made to a "bio-resin", it is to be understood that for embodiments of the invention, the bio-resin is a furan resin, such as a resin comprising prepolymers of furfuryl alcohol. The cured resin may therefore be a poly(furfuryl alcohol). The furanyl resin may be derived from sugar cane, or other sources of sugars, and as such is not only entirely sustainable, but also imparts particularly advantageous properties to the subject assembly. Preferably, the furan resin comprises furfural (furan-2-carbaldehyde) or a derivative of furfural such as furfural alcohol, furan, tetrahydrofuran and tetrahydrofurfuryl alcohol, which are collectively referred to as "furans" herein.

A furan resin may be produced in which furfural replaces formaldehyde in a conventional production of a phenolic resin. The furan resin cross links (cures) in the presence of a strong acid catalyst via condensation reactions. Furfural is an aromatic aldehyde, and is derived from pentose (CS) sugars, and is obtainable from a variety of agricultural by-products. It is typically synthesized by the acid hydrolysis and steam distillation of agricultural by-products such as corn cobs, rice hulls, oat hulls and sugar cane bagasse. Further details relating to furan resins whose use is contemplated in the present invention is set out in "Handbook of Thermoset Plastics", edited by Sidney H. Goodman, Edition 2, Published by William Andrew, 1998, ISBN 0815514212, 9780815514213, Chapter 3: Amino and Furan Resins, by Christopher C. Ibeh. Furan resins are of particular interest because they are derived from natural, renewable sources, they bond well to fibres and they have good flame-retardancy properties.

The bio-resin preferably includes an acid catalyst. The catalyst promotes curing via condensation reactions, releasing water vapour. The bio-resin may further include a blocker component. The function of the blocker component is to affect the curing behaviour of the bio-resin.

Preferably, humins may be added to the to furfuryl alcohol binder. In this specification humins are the coloured bodies which are believed to be polymers containing moieties from hydroxymethylfurfural, furfural, carbohydrate and levulinic acid. These coloured bodies are produced as by-products in the partial degrading of carbohydrates by heat or other processing conditions, as described in e.g. EP 338151. Humins are believed to be macromolecules containing furfural and hydroxymethylfurfural moieties. Further moieties that may be included in humins are carbohydrate, levulinate and alkoxymethylfurfural groups.

The composition further preferably comprises an acidic polymerization initiator having a $pK_a$ at 25° C. of at least 3. Such initiators can be selected from Brønsted and Lewis acids. The acidic initiators may be organic or inorganic. Examples of inorganic Lewis acids include aluminium trihalide, e.g. trichloride, boron halide, e.g. trichloride, zinc halide, e.g. dichloride, iron halide, such as ferrous chloride and ferric chloride, chromium halide, such as chromium trichloride, and iodine. Preferably, the acidic initiator is organic and suitably selected from maleic anhydride, phthalic anhydride, formic acid, maleic acid, malic acid, phthalic acid, furoic acid, benzoic acid, furan-dicarboxylic acid, citric acid, levulinic acid and combinations thereof. The acidic initiator is suitably added in an amount that provides for a sufficiently fast and complete polymerization reaction, especially when heated to the desired thermosetting temperature. Preferably, the amount of acidic initiator is in the range of 0.5 to 10% wt, based on combined amount of furfuryl alcohol and, where applicable humins.

The first component, the second component or both components may not only contain the compounds indicated, but may also include one or more additional compounds, optionally selected from additional monomers, co-catalysts, diluents, fillers and combinations thereof.

Additional monomers may advantageously be selected from 5-hydroxymethylfurfural (HMF), 2-(2-hydroxyacetyl) furan, 5-alkoxymethylfurfural, formaldehyde, methyl formate, levulinic acid, alkyl levulinates, 2,5-diformyl-furan, carbohydrates and furfural and combinations thereof. The use of these monomers has the advantage that similar moieties can already be present in the humins so that these additional monomers seamlessly integrate with the polymer of furfuryl alcohol and the humins. The relative amount of these additional monomers may vary within wide ranges. When they are elected from the compounds hereinabove, these compounds have groups that are also present in humins. Therefore they can be added to the humins in very small to extremely large quantities. Generally, economic considerations promote that a small amount of additional monomers is used and a large amount of the by-product humins. Commonly, the amount of additional monomers may vary from 0 to 20% wt, based on the combined amount of furfuryl alcohol and humins.

In addition, either of the components may also contain a prepolymer of furfuryl alcohol. The prepolymer is a resinous product and is available under the trademark Furolite™ (ex TransFurans Chemicals). The preparation of these prepolymers is known in the art. An example of a known preparation method is described in U.S. Pat. No. 2,571,994.

Fibre Mesh Components

The sheathing comprises at least one layer of a interwoven or layered fibres, referred to herein as "fibre mesh".

Suitable fibres include inorganic fibres, such as glass or metal fibres, and organic fibres, including synthetic fibres such as carbon fibres, polyester fibres, polyamide fibres, such as nylon and poly-paraphenylene terephthalamide, or aramid fibres, and polyolefin fibres such as PE or PP fibres, as well as a broad spectrum of natural fibres. Preferably, the natural fibres are plant-derived fibres. Preferably, the plant-derived fibres are one or more selected from the following: hemp, jute, flax, ramie, kenaf, rattan, soya bean fibre, okra fibre, cotton, vine fibre, peat fibre, kapok fibre, sisal fibre, banana fibre or other similar types of bast fibre material. Such fibres are considered to be annually renewable, in that they are based on a crop which can be grown, harvested and renewed annually. Useful natural fibres typically have an average length of at least 10 mm, more preferably at least 20 mm, at least 30 mm, at least 40 mm, at least 50 mm, at least 60 mm or at least 70 mm. The fibres may be processed, e.g. cut, to have a maximum length of up to 150 mm, for example.

Where made of heat shrinkable fibres or filaments, these preferably heat stabilized prior to being used to construct the composite structural material of the present invention. When made of a monofilament, the fibres preferably have a diameter of from 0.1 mm to 3.0 mm, more preferably from 0.4 mm to 1.5 mm When made of multifilament, the fibre preferably has a denier of from 600 to 1,000, most preferably 900.

In a preferred embodiment, reinforcing fibres can be unconnected one to the other, or they can be laterally connected, e.g., by cross-fibres. The latter arrangement has the advantage that it maintains the longitudinal fibres in place during the formation of the sheathing layer, and provides resilience in different directions.

An advantageous way of providing the fibres in this fashion is to use a strip of mesh or cloth in which the longitudinal cords constitute the warp, i.e., the "yarn," "fibre," or "thread" that is in the mesh's "machine direction." By "mesh" is here meant either a woven cloth or a cross-laid scrim. The latter is a nonwoven netting formed by laying parallel rows of continuous yarn or thread in the warp direction and then laying parallel rows of cross yarns or threads on top of that layer, at a 90° angle thereto, and bonding the two layers together at the cord intersections, e.g., either by thermal bonding or by use of an adhesive, or by a resin impregnation. When a cross-laid scrim or mesh is used, the warp side can either face outwardly form the composite or inwardly. Preferably, however, it will face outwardly and will be next to a layer of web material. If the mesh comprises any shrinkable fibres or filaments, preferably those will be heat stabilized before the mesh is used to construct the panels of the present invention. It is preferred that the cross-fibres, i.e., the woof or weft of the mesh, also sometimes called the "pic" or the "fill", are of a smaller diameter and/or of a lesser density than the warp. Thus, for example, the diameter or denier of the warp cords may be about 1.8 to 2.5 times that of the woof cords, and the density of the warp cords, i.e., the number of cords per lateral inch of the cloth, may be about 1.5 to 3 times the density of the woof cords.

The fibres can be made of continuous filament or staple fibres. Monofilament fibres can be used, but fibres made of a plurality of continuous filaments (so-called "multifilament" fibres) is preferred. Preferred multifilament fibres is that which is made of about 40 to 70 filaments. If multifilament fibres are used, the filaments can be twisted or untwisted. If twisted, it is preferred that the cord have not more than 3.25 twists per inch.

Where more than one layer of laminate is applied, for each skin layer, the fibres are preferably arranged substantially randomly but substantially parallel to each face of the skin layer.

The fibre mesh may thus be a woven meshes, or a non-woven mesh. The latter may be formed by needle punching, or alternatively, by air laying.

As for breaking elongation, preferably the fibres are in the range of about 10 to 50%, e.g., about 20 or 25% to about 45 or 50%. Most preferred for monofilament fibres is a breaking elongation of about 30 to 40%, e.g., about 35%. Most preferred for multifilament fibres is a breaking elongation of about 15 to 20%, e.g., about 17%.

The area density of the fibre mesh may advantageously be in the range 300-3000 grams per square metre (gsm).

Preferably the fibres used in the laminar covering has a tensile strength in the range of about 5 to 18 pounds per cord, most preferably about 16 pounds. The fibres preferably have a breaking tenacity of about 0.67 to 1.10 gf/TEX, most preferably about 0.85 gf/TEX.

The mesh can be made in whole or in part of either natural or synthetic fibres. The choice of fibres, directions, density and The application of the binder system to the mesh may be achieved through different processes. For example it may be contact-coated, e.g. using a roller coating process, or sprayed. Alternative coating processes include blade impregnation coating, sprinkling, painting, dipping, and so on. The purpose of using different application processes relates to the properties of the different resins having different physical properties, such as wetting or different viscosities, and so the different resins are most efficiently applied to the mesh using different application processes. Furthermore, different quantities of resin may be applied to each face of the mesh.

The characteristics of the final product can be varied considerably according to need by varying the distribution of the resin through the mesh, its thickness and the pressure applied.

The process of impregnation of the resin into the natural mesh can be in the form of a continuous process. In that case, the width of the mesh is limited only by the width of the coating machinery.

The manufacture of the assembly according to the present invention may include a wet lay process, whereby first the mesh is applied, and then the binder system is applied, and the assembly is then subjected to a curing step. Alternatively, the resin-impregnated mesh can be prepared as a "prepreg", whereby the prepreg is cut to length as desired, applied to the wood composite panel, and then pressed and/or cured in a static press, or in an autoclave. This is preferably performed in a vacuum bag, or in a heated mold.

Further skins may be applied e.g. the panels receive additional sin payers or wrapping with durable surface foils, such as façade films, or coatings, the latter of which as usually applied after the panel is prepared, whereas wrapping can be included in the lamination process.

Preferably, the water content of the bio-resin prior to curing is higher than 5 wt %. Also preferably, the bio-resin comprises a particulate filler component, e.g. a fire retardant, such as micro-encapsulated ammonium polyphosphate.

Insulation and Filling

The channels may advantageously comprise heat and/or noise insulating materials. Suitable materials may be selected from polymer foams, glass fibre-based materials, mineral or natural wool and/or cellulose-based materials. Appropriate heat insulating material may be selected from the group consisting of quilted materials, polymer foam, glass fibre-based material, mineral wool and a cellulose-based material, such as e.g. cork. Preferred polymeric materials comprise expanded or extruded polymer foams. Conveniently, the polymer is selected from the group consisting of PET, polyurethane, polyethylene and polystyrene.

Curing and Adhesive Process

The curing process for the panel includes heating. The heating step typically heats the panel to a temperature of at least 110° C. Preferably, in this step, the panel is heated to a temperature of 180° C. or lower, more preferably 160° C. or lower. A typical temperature for this heating step is 115° C. to 140° C. The curing is suitably effected by heating the composition to a temperature in the range of 50° C. to 200° C., preferably from 90 to 160° C.

The time period for heating is determined by the desired curing degree, and can range of from 1 hour to 24 hours.

The curing process for the panel further preferably includes subjecting the panel to pressure. By the combination of heating and pressure, the impregnated fibre sheathing is typically permanently compressed so that the density of the skin layer after heating and pressing is at least 1.5 times the density of the impregnated mesh before heating and pressing.

Further

The invention will now be described in more detail with respect to the following, specific, non-limiting examples.

Example

Floor assemblies were prepared according to the present invention as follows. The floor structures were 122 cm feet wide, 244 cm long, and 55 cm thick. The upper and lower composite wood boards were OSB/4 boards of 2.5 cm thickness.

Figure 2:
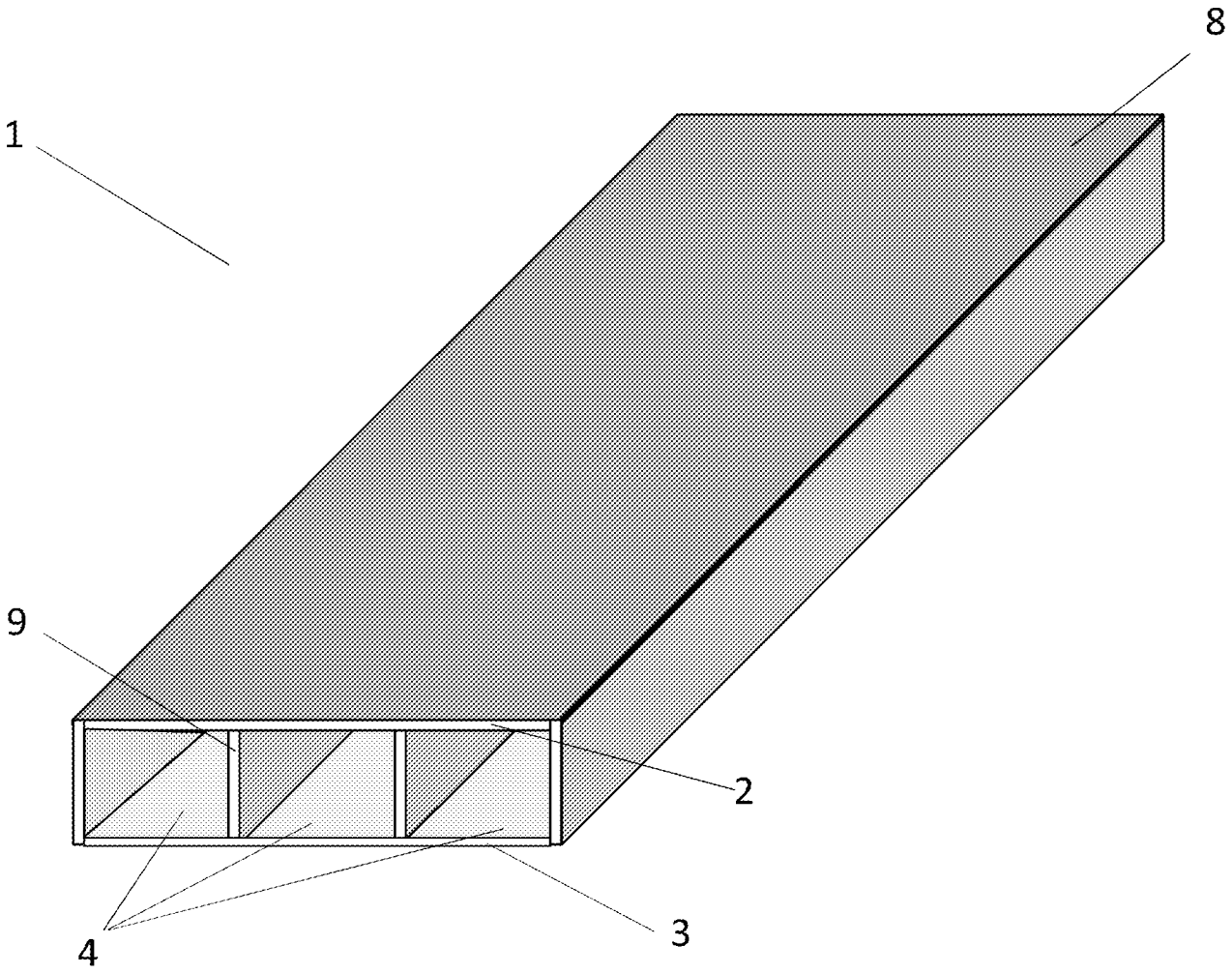
FIG. 2 is a side elevational and top plan views of a floor structure formed of a plurality of abutting structural flooring panels.

Between the upper and lower composite wood boards were arranged three channels, cross sectional illustrations and dimensions of these channels are shown in FIG. 2. The channels themselves were 244 cm long, and joists as well as 2 web plates were running along the channels at a longitudinal spacing of one joist or stiffener at every 30 cm.

To secure the joists and web plates to the composite wood boards, strip of the same prepreg mash was employed at the top and bottom of each web plate as shown in FIG. 2, contacting the web plates. All of these strips ran the entire length of the floor structure.

The present invention performed as required by the building safety and strength requirements for floors, while offering sufficient stiffness and firmness of the floor. Yet further, the panels also showed a very low smoke production in case of fire, meeting international standard S1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A lightweight composite architectural panel assembly, comprising:

a) one or more first end joists and one or more second end joists spaced parallelly along a perimeter of the assembly, each having a length;

b) one or more web plates spaced parallelly between the end joists; one or more first upper surfaces arranged at a first distance to one or more lower surfaces; and attached to the first end joist, the second end joist, and the web plate, forming one or more channels disposed vertically between the upper surface and the lower surface and longitudinally extending along the first upper surface and the first lower surface, thereby forming an open-ended boxlike body; and c) a structural vertically load-bearing sheathing layer enveloping and adherent to an outer surface of the open-ended boxlike body, wherein the sheathing layer comprises a composite skin comprising a fibre mesh and a crosslinked polymeric resin system, wherein the polymeric resin system comprises Polyfurfuryl Alcohol (PFA) resins and curing or crosslinking agents.

2. The assembly according to claim 1, wherein the first upper surface, the first lower surface, the first end joist, and the second end joist are arranged in a rectangular, triangular, polygon or trapezoid shape, wherein the first upper surface or the first lower surface are arranged in parallel, or wherein the first upper surface or the first lower surface are arranged at an angle to a respective first upper surface or first lower surface.

3. The assembly according to claim 1, wherein the upper surface, the lower surface, the first end joist, the second end joist, the web plate, or a combination thereof, comprise a wood composite panel.

4. The assembly according to claim 3, wherein the wood composite panel are oriented strand board.

5. The assembly according to claim 1, further comprising an adhesive joint applied between an upper surface and a lower surface of the first end joist, the second end joist, and the web plate and an inner surface of the first upper surface and the first lower surface.

6. The assembly according to claim 5, wherein the structural vertically load-bearing sheathing layer comprises a fibre mesh at least partially impregnated with the Polyfurfuryl Alcohol (PFA) resin.

7. A method of manufacturing an assembly according to claim 1, comprising:

a. providing the fibre mesh impregnated with the resin and curing agent;

b. providing the first end joist and the second end joist spaced parallelly along a perimeter of the assembly, each having a length; the web plate spaced parallelly between the end joists; the upper surface arranged at a distance to the lower surface; and attached to the first end joist and the second end joist and the web plate, forming the channel disposed vertically between the first upper surface and the first lower surface and longitudinally extending along the first upper surface and the first lower surface, thereby forming the open-ended boxlike body; and joining the first end joist, the second end joist, and the web plate to the first upper surface and the first lower surface by providing strips of the fibre mesh impregnated with the resin and curing agent as adhesive joints upon curing;

c. for each side of the open-ended boxlike body, applying a portion of the impregnated fibre mesh onto a core so that a second face of the impregnated fibre mesh is in contact with the core, thereby forming a sandwich construction; and d. subjecting a precured assembly to a curing process under conditions that are suitable for crosslinking the resin, wherein curing temperature, curing speed, viscosity, water content, and curing pressure such to compress the impregnated fibre mesh and allow for ingression of at least part of the resin into the assembly prior to curing.

8. A method according to claim 7, wherein the first upper surface, the first lower second-surface, the first end joist, and the second end joist are arranged in a rectangular, triangular, polygon or trapezoid shape, wherein the first upper surface or the first lower surface are arranged in parallel, or wherein the first upper surface or the lower surface are arranged at an angle to a respective first upper surface or first lower surface.

9. A method according to claim 7, wherein the water content of the Polyfurfuryl Alcohol (PFA) resin prior to curing is higher than 5 wt %.

10. A method according to claim 7 wherein the resin comprises a fire retardant, a particulate filler component, or a combination thereof.

11. A method according to claim 10, wherein the fire retardant comprises micro-encapsulated ammonium polyphosphate.

12. A composite load bearing panel having a sandwich construction obtainable according to claim 7.

* * * * *